US006808090B2

(12) United States Patent
Pedersen

(10) Patent No.: US 6,808,090 B2
(45) Date of Patent: Oct. 26, 2004

(54) CONTAINER AND CONTAINER SUPPORT

(76) Inventor: Oeyvind Pedersen, Dyrborgveien 23, Trondheim (NO), N-7020

( * ) Notice: Subject to any disclaimer, the term of this patent is extended or adjusted under 35 U.S.C. 154(b) by 0 days.

(21) Appl. No.: 10/388,983

(22) Filed: Mar. 14, 2003

(65) Prior Publication Data

US 2003/0178443 A1 Sep. 25, 2003

Related U.S. Application Data

(60) Provisional application No. 60/366,412, filed on Mar. 12, 2002.

(51) Int. Cl.[7] ..... B67D 5/00

(52) U.S. Cl. ..... 222/181.3; 222/181.1; 215/399; 220/481; 220/483; 220/751; 248/205.5; 248/205.6; 248/206.1; 248/206.2; 248/309.3; 248/311.3

(58) Field of Search ..... 222/180–181.3; 215/399; 220/480, 481, 483, 751, 775; 248/205.5–206.2, 309.3, 311.3

(56) References Cited

U.S. PATENT DOCUMENTS

| | | | | | |
|---|---|---|---|---|---|
| 464,823 | A | * | 12/1891 | Foster | 222/181.2 |
| 2,364,326 | A | * | 12/1944 | Stephens | 141/370 |
| 3,071,886 | A | | 1/1963 | Stiller | |
| 3,366,360 | A | | 1/1968 | Burke | |
| 3,388,835 | A | | 6/1968 | Naughten | |
| 4,166,553 | A | | 9/1979 | Fraterrigo | |
| 4,408,704 | A | | 10/1983 | Horvath | |
| 4,548,340 | A | | 10/1985 | Messer | |
| 4,728,006 | A | | 3/1988 | Drobish et al. | |
| 4,805,790 | A | | 2/1989 | Leonetti et al. | |
| 4,969,580 | A | | 11/1990 | Mikhail | |
| 5,176,347 | A | | 1/1993 | Rouail | |
| 5,271,560 | A | * | 12/1993 | De Winter | 239/42 |
| 5,435,511 | A | | 7/1995 | Hsu | |
| 5,673,884 | A | | 10/1997 | Yemini | |
| 5,749,490 | A | | 5/1998 | Keicher | |
| 5,850,945 | A | | 12/1998 | Frankel | |
| 5,924,605 | A | | 7/1999 | Baudin et al. | |
| 5,947,322 | A | * | 9/1999 | Ho | 220/477 |
| 5,992,698 | A | | 11/1999 | Copeland et al. | |
| 6,041,971 | A | | 3/2000 | Pineda | |
| 6,062,441 | A | | 5/2000 | Mengeu et al. | |
| 6,343,712 | B1 | | 2/2002 | Flackett et al. | |
| 6,394,315 | B1 | | 5/2002 | Banks | |
| 6,533,145 | B2 | * | 3/2003 | Lewis et al. | 222/181.3 |
| 2002/0005414 | A1 | * | 1/2002 | DeKoning et al. | 222/181.3 |
| 2002/0043535 | A1 | * | 4/2002 | Immerman | 220/483 |

* cited by examiner

*Primary Examiner*—J. Casimer Jacyna
(74) *Attorney, Agent, or Firm*—Brinks Hofer Gilson & Lione

(57) ABSTRACT

A container and support for supporting the container on a wall or other vertical structure. The support has a flexible disk housed within a rigid shell having central opening. A stem protrudes from the disk through the shell opening. A handle is movably coupled to a distal portion of the stem to move between a first and a second position. The movement from the first to the second position causes a force on the stem distorting the flexible disk causing a supporting vacuum between the disk and any contiguous wall. The handle includes an edge for engaging a cooperating portion of a container when the handle is in the second position. The container has a tubular body with a closed bottom and an open top through which any contents of the container can be dispensed. A closure secured to the open top controls the dispensing of the container contents. The tubular body of the container includes a pocket having at least one rim shaped to cooperate with the handle to hold the container.

5 Claims, 3 Drawing Sheets

Fig. 1

CONTAINER AND CONTAINER SUPPORT

CROSS-REFERENCE TO RELATED APPLICATIONS

The present application is related to and claims the benefit of U.S. provisional application Ser. No. 60/366,412 filed Mar. 21, 2002.

BACKGROUND OF THE INVENTION

The present invention relates to liquid-dispensing container constructions and supports therefore, and in particular to container constructions for mounting a dispensing container in an inverted position within a bath or shower for dispensing a desired amount of liquid such as shampoo, cream rinse, body wash, or the like.

People normally keep a number of containers of different types in the shower of their bathroom, typically containing shampoo, hair conditioner, soaps or the like. Most of these bottles are too big to put on the built in shelves, which are typically designed for a bar of soap or an object of that size. Aftermarket shelves are available, but they take up space and they introduce yet another surface that needs to be cleaned. What is really needed is a way to get the containers to hang on a wall where they would be easily accessible during the bath/shower.

One solution available is to mount an automatic liquid dispenser on the wall. See, e.g., U.S. Pat. Nos. 4,166,553, 5,992,698 and 6,041,971. This gives the user easy access to the products during showering, and it eliminates some of the clutter of bottles. However, it also introduces a few problems for both the user and the manufacturers. The automatic dispenser itself has to be permanently fixed to the wall with screws or glue to work properly. Fixing anything with screws to a bathroom wall is less than ideal and sometimes impossible, and glue good enough to hold a dispenser on a tile or glass wall will make it hard to replace or remove the unit at a later stage. If one plans ahead while building a bathroom, one can flush mount a dispenser in the wall (See, e.g., U.S. Pat. No. 4,548,340), but it is very unlikely that this ever will be a large market. Another problem with the dispenser solution is that it leaves one with two choices when the dispenser needs to be refilled. Either the user has to fill the dispenser manually by pouring the contents from another container (See, e.g., U.S. Pat. No. 4,548,340). This filling operation tends to be time-consuming and messy. Alternatively, an inner cartridge can be replaced. (See, e.g., U.S. Pat. No. 5,992,698). In the latter case, the manufacturer will lock itself to a certain design and size of the cartridge, leaving the marketing department little to work with to make it stand out on the grocery store shelf without adding packaging. Using an automatic dispenser also limits the number of products one can have, unless the unit is made very big or several of the units are used.

Another solution is to make a hanger that accommodates bottles of different designs and sizes. The main problem is that these mechanisms get overly complicated (See, e.g., U.S. Pat. No. 3,366,360) and one will still need some means of attachment to the wall.

One can also make a device that hangs from the plumbing fixtures in the shower, like the pipe of the shower stall, curtain rod or bar of soap dish (See, e.g., U.S. Pat. No. 4,969,580). This can also be an integrated design feature of the bottle itself (See, e.g., U.S. Pat. Nos. 4,728,006 or 5,479,497), but this structure will generally limit the number of different products one can fit the shower, before having to resort to using the shower floor or shelves. In many cases, it will not be accessible to short users.

Yet another solution is to make an all-in-one product with an automatic dispenser with suction cups on one side. (See, e.g., U.S. Pat. Nos. 5,850,945 or 6,343,712). This may work for small dispensers, provided that the suction cups are fitted properly. In any case, this will add considerable cost to the packaging and production of the product.

The last group of prior art tries to solve the problem by using suction cups. U.S. Pat. No. 3,071,886 discloses a device with several suction cups that can accommodate any container with one relative flat side. The problem with suction cups is that they require a certain force to release the container, and in order to be strong enough to make a 700 gram bottle hang for days/weeks, the force needed to release the container will be considerable. U.S. Pat. No. 5,673,884 tries to solve this by using two parts. A base with a suction cup attaches to the wall, and an adapter with a suction cup holding the bottle. This design has two obvious flaws. First of all, suction cups will not be able to hold a typical shampoo or hair conditioner bottle, since the walls of the bottle are not flat or rigid enough to keep the vacuum needed to make the suction cup hold the bottle. Secondly, a better docking system is needed to connect the two parts. The latter could be improved, but the first flaw would seriously limit what kind of bottles this system could accommodate. U.S. Pat. No. 5,749,490 uses another approach with using a hanger of a web of polypropylene. Preinstalled on bottles in the stores this might work, but it still would require special packaging and the suction cup would need to be very large to be able to hold a typical "family size" bottle.

Thus there remains the problem of providing a convenient way to suspend bottles of liquid soap, shampoo, hair conditioner, and other bathing products from a wall of a shower or tub enclosure without using permanent fixtures, cements, adhesives or other materials that cannot be easily removed from the wall, while still providing all the support necessary for a full bottle of the bathing product.

SUMMARY OF THE INVENTION

The present invention overcomes this problem by using a container support that includes a suction disc with a lever/handle to reduce the air pressure between the disc and the surface, and a customized bottle to slide onto the handle of this suction cup. With the increased vacuum, a single suction disc of a relatively small diameter can be used to hold a heavy container, compared to using single-piece suction cups.

The suction disc can easily, and with little force, be removed to permit cleaning of the wall of the shower, or to reposition the container support to another location. The suction disc with the lever is more expensive to produce than single-piece suction cups, but they are still relatively cheap and are reusable.

The containers need to be designed to be able "to dock" on the handle. The container can have a generally tubular body having a closed bottom and an open top through which any contents of the container can be dispensed. A closure having any of a variety of designs can be secured to the open top, such as are disclosed in U.S. Pat. Nos. 4,408,702; 4,805,790; 5,924,605; 6,062,441; or 6,394,315. The generally tubular body can include a pocket having at least one edge adapted to cooperate with the handle of the support to hold the container. The lateral extent of the pocket should be sufficient to make the docking operation very easy even when one's eyes are closed. The manufacturer can choose whether to make the container hang with the neck up or down. Depending on the current design of the bottle, this may or may not introduce moving parts to the mould used to form the container. Once designed and the modified moulds are made, this system should not add considerable production costs to the bottles.

The docking feature of the bottle will give the manufacturer a unique selling point in the marketing of their product. If the manufacturer has a line of products, containers for all the products can be made to fit the same suction disc handle. The manufacturer can also provide a compatible adapter made of a single plastic part that can be permanently fixed to the wall. Some users may want this in other parts of the bathroom or other rooms, where suction cups cannot be mounted. (Wood, painted dry walls etc.)

Since the modification of the bottle can be made without severely changing the original design of the bottle, the marketing efforts in the original design are not lost. When the bottle hangs on the wall, the suction disc is barely visible, and the design of the bottle is very visible to the user, at least more so than when a container is standing on the floor, thus reducing the likelihood of selecting the wrong container for use at some point during a shower.

The shape of the handle can made in a shape that allows the bottle to swing from side to side, which might be preferable to minimize the stress on the bottle if the user accidentally should collide with the bottle during showering. If the bottle is an automatic dispenser, one might want to the bottle to remain in a fixed position, and use another shape of the handle.

All in all, the invention solves one very common problem for the user, and provides the manufacturer with a marketing advantage in a market that today relies heavily on branding and advertising. Additional features and advantages of the present invention will become apparent to those skilled in the art from a consideration of the following description of preferred embodiments taken together with the accompanying drawings illustrating the best mode of the invention as presently conceived.

DETAILED DESCRIPTION OF THE DRAWINGS

Figure 2:
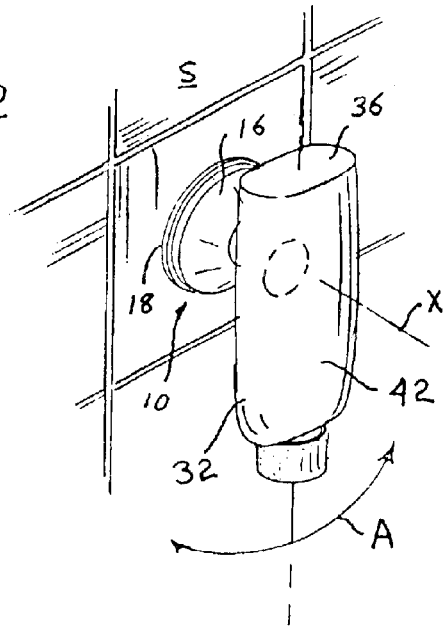
FIG. 2 is a perspective view of the bottle and support of FIG. 1.
Figure 1:
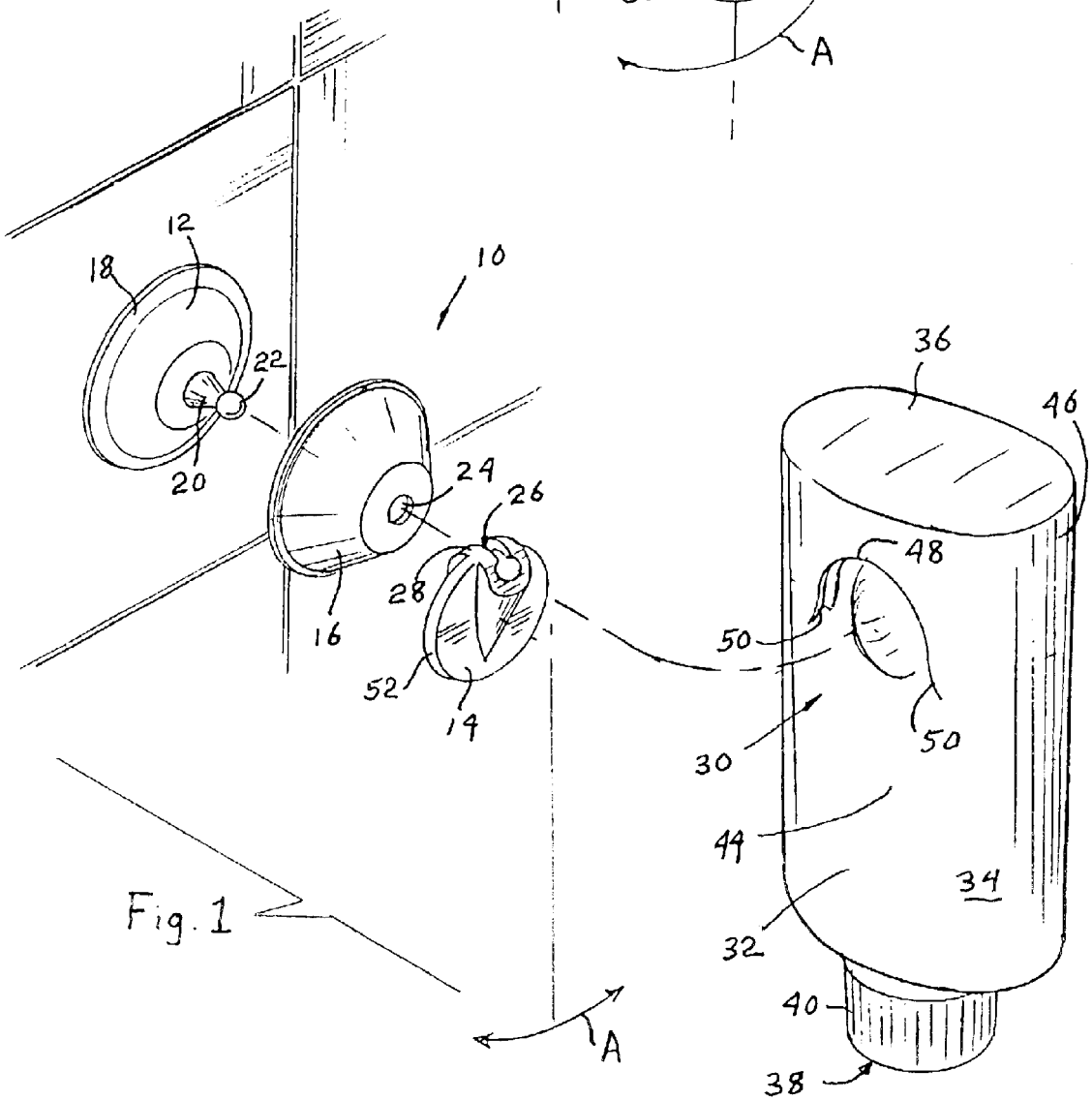
FIG. 1 is an exploded perspective view of a suction disc support with a hanger and a bottle of the present invention.
Figure 3:
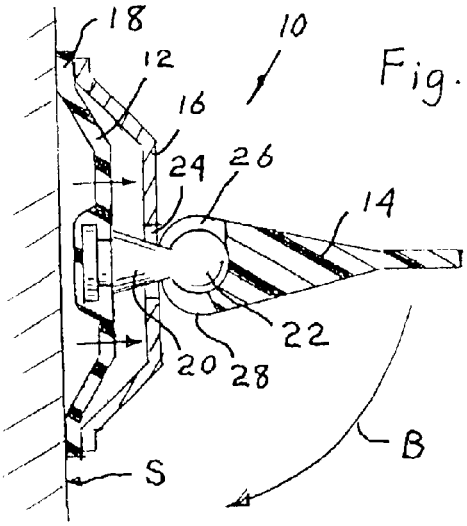
FIG. 3 is a sectional view of the suction disc of FIG. 1 with the hanger located in a first position.
Figure 4:
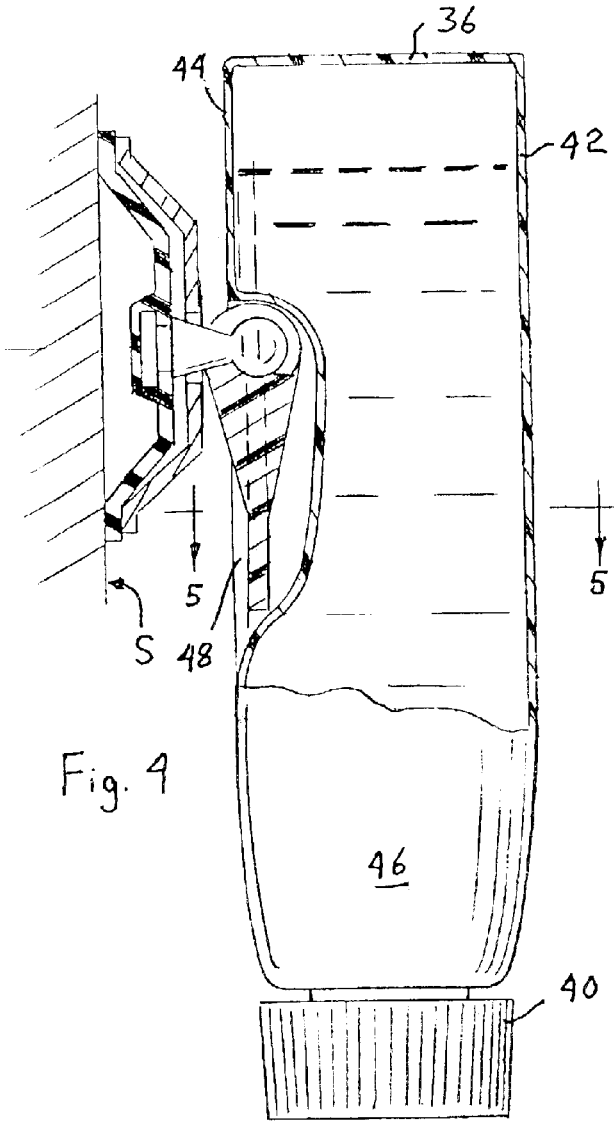
FIG. 4 is a sectional view of the bottle and support with the hanger located in a second position and engaged with the bottle pocket.
Figure 5:
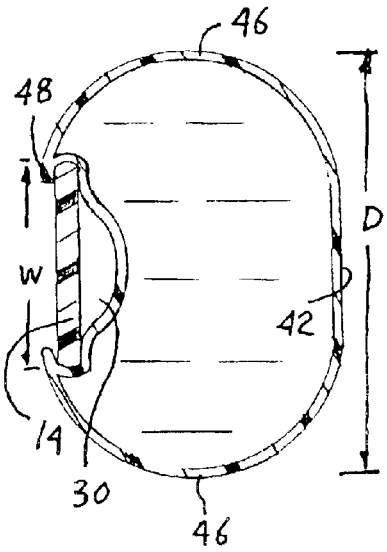
FIG. 5 is a sectional view taken along line 5—5 in FIG. 4.

A first embodiment of the present invention is shown in FIGS. 1–5. The support or hanger assembly 10 includes a suction disc 12 and a handle 14 assembled together with an intermediate shell 16. The suction disk 12 is formed of an elastic material, such as rubber, and includes a continuous perimeter 18. A stem 20 is fixed to the center of disk 12, preferably by molding the disk 12 around the stem 20. The stem 20 includes an enlarged end portion 22. The end portion 22 and an adjacent part of stem 20 project through a central opening 24 in shell 16. Both the stem 20 and the shell 16 are made of a material that is structurally more rigid than the suction disk 12 so that any deformation due to stress will occur first in the disk 12. The enlarged end portion 22 is engaged in a slot 26 in handle 14 so that the handle 14 can be moved relative to the stem 20. The handle 14 includes an eccentric surface 28 adjacent to the slot 26 so that displacement of the handle 14 from a horizontal position shown in FIG. 3 in the direction of arrow B to a vertical position shown in FIG. 4 causes the stem 20 and central portion of disk 12 to be drawn into the shell 16. If the perimeter 18 is in continuous contact with a supporting surface S, the movement of the central portion of the disk 12 into the shell 16 also moves the central portion of the disk 12 away from the supporting surface S, thus causing a partial vacuum to develop between the supporting surface S and the disk 12.

When the hanger assembly 10 is fixed to a supporting wall S, the essentially vertical handle 14 can be used to engage a recess 30 in the bottle container or bottle 32 so that the bottle 32 is suspended from the supporting wall S by the hanger assembly 10. The bottle 32 is seen to have a generally tubular body 34 having a closed end 36 and an open end 38 through which any contents of the container 32 can be dispensed. The closed end 36 is shown to be generally planar thus forming a supporting bottom for the bottle when on display in a typical sales situation. A closure 40 is secured to the open end 38 to retain the contents of the bottle 32. In the normal display attitude wherein the bottle 32 is supported on the closed end 36, the open end 38 and closure will be located at the top of the container 32.

The generally tubular body 34 of the container 32 includes a front surface 42 and a back surface 44. The surfaces 42 and 44 can be used to receive informational and/or decorative elements that typically identify the contents of the container 32 as well as provide information on the use of the contents, etc. While the front surface 42 is shown to be essentially smooth, it is within the scope of the present invention that the front surface 42 as well as sides 46 can be sculpted or shaped to any design of choice to achieve an attractive container of a suitable volume. The back surface 44 of the generally tubular body 34 includes the recess or pocket 30. The recess 30 has a rim 48 shaped to engage the handle 14 so that the hanger assembly 10 can hold the container 32. The rim 46 of the pocket 30 includes tapered edges 50 facilitating the temporary removal from, and replacement of the container 32 onto, the handle 14 of the hanger assembly 10. The replacement of the container 32 onto the hanger assembly 10 is also facilitated by having the lateral dimension W of the pocket 30 sufficiently large that, together with the tapered edges 50, the replacement is easily done even with one's eyes closed. The lateral dimension W is preferably at least about 30% of a diameter D of the container 32. In the illustrated embodiment, the lateral dimension W is about 50% of the diameter D of the container 32.

In this first embodiment of the invention, the handle 14 has a generally circular perimeter 52 that cooperates with the generally circular rim 48 of the recess 30 to allow the bottle 32 to swing from side to side about axis X as shown by arrows A. This interaction between the rim 46 and the perimeter 52 of handle 14 will minimize any stress on the bottle 32 if the user accidentally should collide with the bottle during showering. While the container 32 is shown to be suspended on the handle 14 in an inverted position, it will be appreciated that an upright positioning of the bottle 32 is also possible by simply inverting the geometry of the pocket 30 and locating the pocket 30 closer to the upper end 38 of the container 32.

Figure 6:
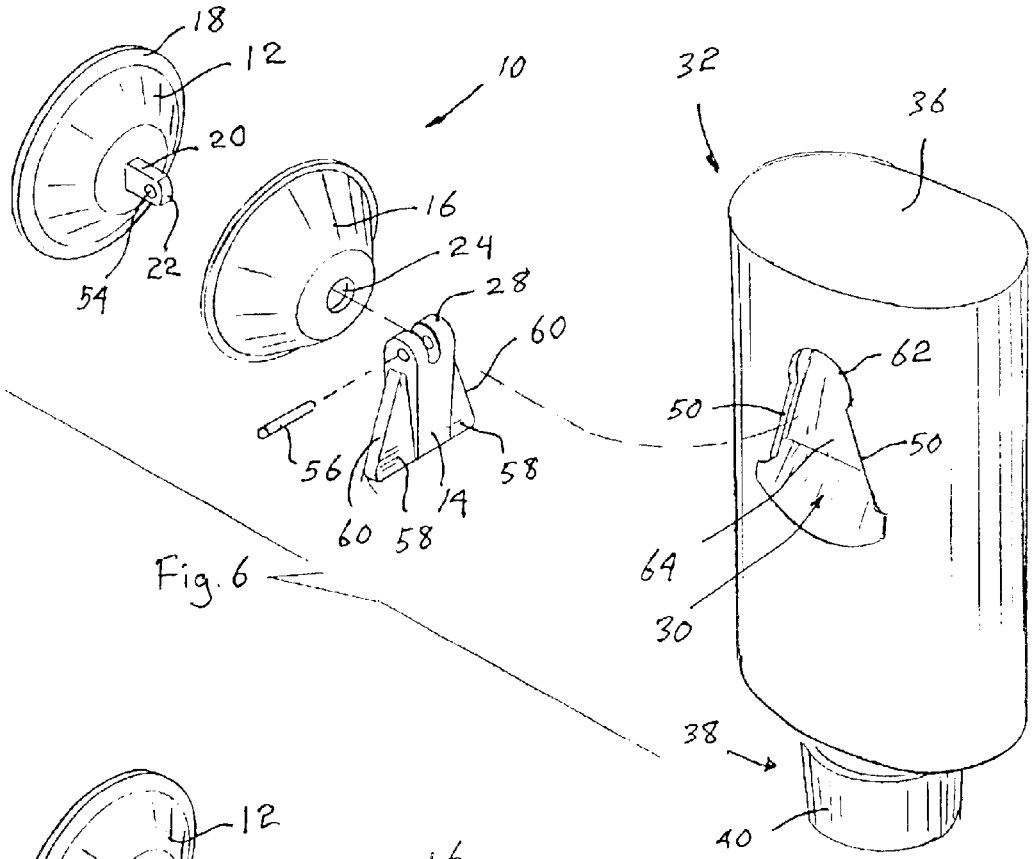
FIG. 6 is an exploded perspective view of another suction disc support with a hanger and a bottle of the present invention.

A second embodiment of the invention is shown in FIG. 6 wherein the stem end 22 of the hanger assembly 10 includes an opening 54 and a pin 56 is shown to be received through the opening 54 to couple the stem 20 to the handle 14. The handle 14 has a generally triangular conformation achieved by the presence of lateral wings 58 having angled surfaces 60 that can be used to engage the tapered edges 50 of recess 30. In the bottle 32 shown in FIG. 6, the tapered edges 50 are essentially linear and converge toward a circular apex 62. The pocket 30 includes an inclined back wall 64 providing sufficient depth to receive the portion of the handle 14 including the eccentric surfaces 28. This design of hanger assembly 10 fixes the bottle 32 to one position as it does not allow the handle 14 to turn around the stem 20. While the container 32 is again shown in FIG. 6 to be suspended on the handle 14 in an inverted position, it will be appreciated that an upright positioning of the bottle 32 is also possible by simply inverting the geometry of the pocket 30 and locating the pocket 30 closer to the upper end 38 of the container 32

Figure 7:
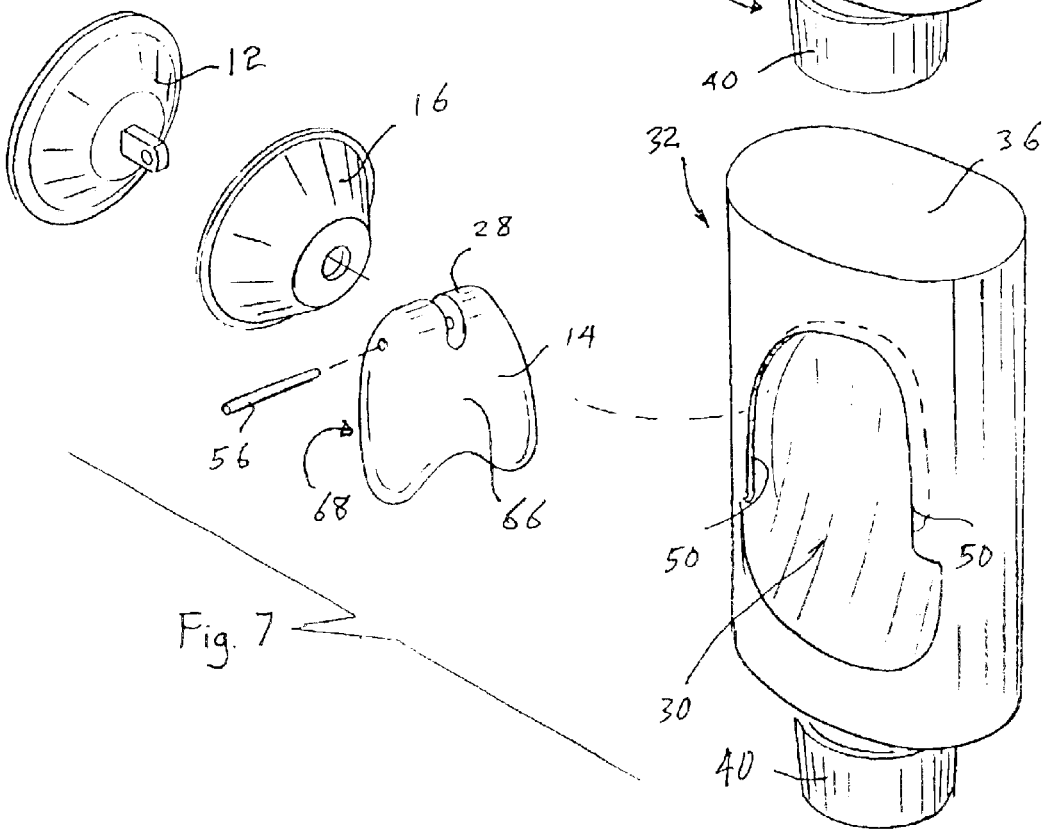
FIG. 7 is an exploded perspective view of an additional suction disc support with a hanger and a bottle of the present invention.

FIG. 7 shows yet another embodiment of a hanger assembly 10 of the present invention wherein the handle 14 has a "fish tail" shape which may be marginally less expensive to make that the prior embodiment as less material is employed in the handle 14. The "fish tail" shape can be formed to include an convex surface 66 and a concave surface 68 to form a non-symmetrical handle 14 that is thinner than the prior embodiments. The pocket 30 in the container 32 includes a tapered edge 50 shaped to cooperate with the "fish tail" shape of the handle 14. It will also be noted that the size of the pocket 30 in the embodiment of FIG. 7 is considerably larger in proportion to the container 32 than in the embodiment of FIG. 6. In all the embodiments, replacement of the container 32 onto the hanger assembly 10 is facilitated by having the lateral dimension the pocket 30 sufficiently large that, together with the tapered edges 50, the replacement is easily done even with one's eyes closed.

It is to be understood that the invention is not limited to the illustrations described and shown herein, which are deemed to be merely illustrative of the best modes of carrying out the invention, and which are susceptible of modification in form, size, arrangement of parts, and details of operation. The invention rather is intended to encompass all such modifications which are within its spirit and scope as defined by the claims.

What is claimed is:

1. A combination of a container and a support for supporting the container at any selected location on a wall or other vertical structure, the support comprising a flexible disk having a continuous edge and a centrally located stem protruding normally from a first surface of the disk, a shell having a perimeter in contact with the first surface of the disk adjacent to the continuous edge and a centrally located opening, the stem including a distal portion protruding through the opening in the shell, and an engagement member movably coupled to the distal portion of the stem so that the engagement member can move between a first and a second position, the movement from the first to the second position causing a tension force to be applied to the stem sufficient to distort a central portion of the flexible disk toward the shell, the engagement member including at least one edge for engaging a cooperating portion of a container when the engagement member is in the second position, the container comprising a generally tubular body having a closed bottom and an open top through which any contents of the container can be dispensed, a closure secured to the open top, the generally tubular body including a pocket having an edge adapted to cooperate with said at least one edge of the engagement member to hold the container.

2. The combination of claim 1 wherein the pocket includes an arcuate edge portion and a tapered edge portion.

3. The combination of claim 2 wherein the pocket is located adjacent to the closed bottom of the container facilitating the support to hold the container in a generally inverted position.

4. The combination of claim 3 wherein a widest lateral dimension of the pocket occupies at least 30% of the width of the container.

5. A support for supporting a container in an inverted position at any selected location on a wall or other vertical structure, the support comprising a flexible disk having a continuous edge and a centrally located stem protruding normally from a first surface of the disk, a shell having a perimeter in contact with the first surface of the disk adjacent to the continuous edge and a centrally located opening, the stem including a distal portion protruding through the opening in the shell, and an engagement member movably coupled to the distal portion of the stem so that the engagement member can move between a first and a second position, the movement from the first to the second position causing a tension force to be applied to the stem sufficient to distort a central portion of the flexible disk toward the shell, the distortion causing a displacement of a second surface of the disk sufficient to cause the development of a supporting vacuum between the second surface and any contiguous wall, the engagement member including at least one edge for engaging a cooperating portion of a container when the engagement member is in the second position so that the container is supported in an inverted position.

* * * * *